US008128424B2

(12) United States Patent
Riner

(10) Patent No.: US 8,128,424 B2
(45) Date of Patent: Mar. 6, 2012

(54) ELECTRICAL RECEPTACLE ASSEMBLY

(75) Inventor: Raymond H. Riner, Fort Wayne, IN (US)

(73) Assignee: Group Dekko, Inc., Kendallville, IN (US)

( * ) Notice: Subject to any disclaimer, the term of this patent is extended or adjusted under 35 U.S.C. 154(b) by 118 days.

(21) Appl. No.: 12/775,507

(22) Filed: May 7, 2010

(65) Prior Publication Data

US 2011/0275230 A1 Nov. 10, 2011

(51) Int. Cl.
*H01R 25/00* (2006.01)

(52) U.S. Cl. ..... 439/215

(58) Field of Classification Search ..... 439/207–216
See application file for complete search history.

(56) References Cited

U.S. PATENT DOCUMENTS 5,112,240 A * 5/1992 Nienhuis et al. ..... 439/215
5,178,555 A * 1/1993 Kilpatrick et al. ..... 439/215
6,036,516 A * 3/2000 Byrne ..... 439/215

* cited by examiner

*Primary Examiner* — Truc Nguyen
(74) *Attorney, Agent, or Firm* — Taylor IP, P.C.

(57) ABSTRACT

An electrical receptacle for use with an electrical distribution harness. The electrical distribution harness including a first connector and a second connector, a plurality of electrical conductors electrically connecting the first connector and the second connector, a conduit member at least partially enclosing the plurality of electrical conductors between the first connector and the second connector, at least one fastener element having a head, and at least one structural member connected to the conduit member by way of the fastener element, the head projecting above a surface of the structural member. The electrical receptacle including a housing with at least one recess and a connector extending from the housing. The electrical receptacle being electrically connectable to the first connector or the second connector of the harness. The recess being configured to accommodate the head when the electrical receptacle is engaged in the first connector or the second connector.

20 Claims, 3 Drawing Sheets

ELECTRICAL RECEPTACLE ASSEMBLY

BACKGROUND OF THE INVENTION

1. Field of the Invention

The present invention relates to electrical distribution harnesses for modular wall panels, and, more particularly, to a method and a device for mounting electrical receptacles to the electrical distribution harness of the modular wall panel.

2. Description of the Related Art

Electrical distribution harnesses are located in modular wall panels to provide electrical power to a user located in a space defined by the wall panels. The electrical power can be used to power lighting, computers and other office machines in an office environment, or can be used to power lighting, tools and other equipment in a laboratory or industrial setting.

The electrical distribution harnesses are hidden within the modular wall panel, typically near to or attached to a frame of the modular wall panel, and provide user access to the electricity via receptacles, such as standard duplex receptacles.

The receptacle components need to electrically connect to the electrical distribution harness. Mechanical forces are applied to the receptacle, and therefore to the electrical distribution harness via the receptacle, when plugging and unplugging a power cord and the like. A stable mechanical connection is required for the receptacle to ensure that the receptacle does not work itself loose from the electrical distribution harness after multiple power cord plugging and unplugging cycles. A stable mechanical connection is also required for the electrical distribution harness to ensure that the electrical distribution harness does not work itself loose from the modular wall panel after multiple power cord plugging and unplugging cycles.

A method of mounting a receptacle to an electrical distribution harness is known whereby a receptacle retaining element is part of the electrical distribution harness and includes legs that connect to the modular wall panel. The receptacle electrically connects to an electrical port on the harness and mechanically mounts into the receptacle retaining element.

Wall panels may be made thinner to save space and to reduce the material content therein, yet an electrical receptacle needs to accommodate electrical plugs engaged therein. The thinner wall panels present issues when dealing with electrical interconnections that require a minimum amount of space.

What is needed in the art is a device and method that allows a receptacle of an electrical distribution harness to be connected in a reliable and cost effective manner, and at the same time, have a profile compatible with the smaller space constraints of modular wall panels.

SUMMARY OF THE INVENTION

The present invention provides a device and method to hold a receptacle module to an electrical distribution harness.

The invention comprises, in one form thereof, an electrical receptacle for use with an electrical distribution harness. The electrical distribution harness including a first connector and a second connector, a plurality of electrical conductors electrically connecting the first connector and the second connector, a conduit member at least partially enclosing the plurality of electrical conductors between the first connector and the second connector, at least one fastener element having a head, and at least one structural member connected to the conduit member by way of the fastener element, the head projecting above a surface of the structural member. The electrical receptacle including a housing with at least one recess and a connector extending from the housing. The electrical receptacle being electrically connectable to the first connector or the second connector of the harness. The recess being configured to accommodate the head when the electrical receptacle is engaged in the first connector or the second connector.

An advantage of the present invention is that it provides a device and method that mechanically allows an electrical receptacle to engage an electrical distribution harness in a reliable and cost effective manner.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrate one preferred embodiment of the invention, in one form, and such exemplification is not to be construed as limiting the scope of the invention in any manner.

DETAILED DESCRIPTION OF THE INVENTION

Figure 1:
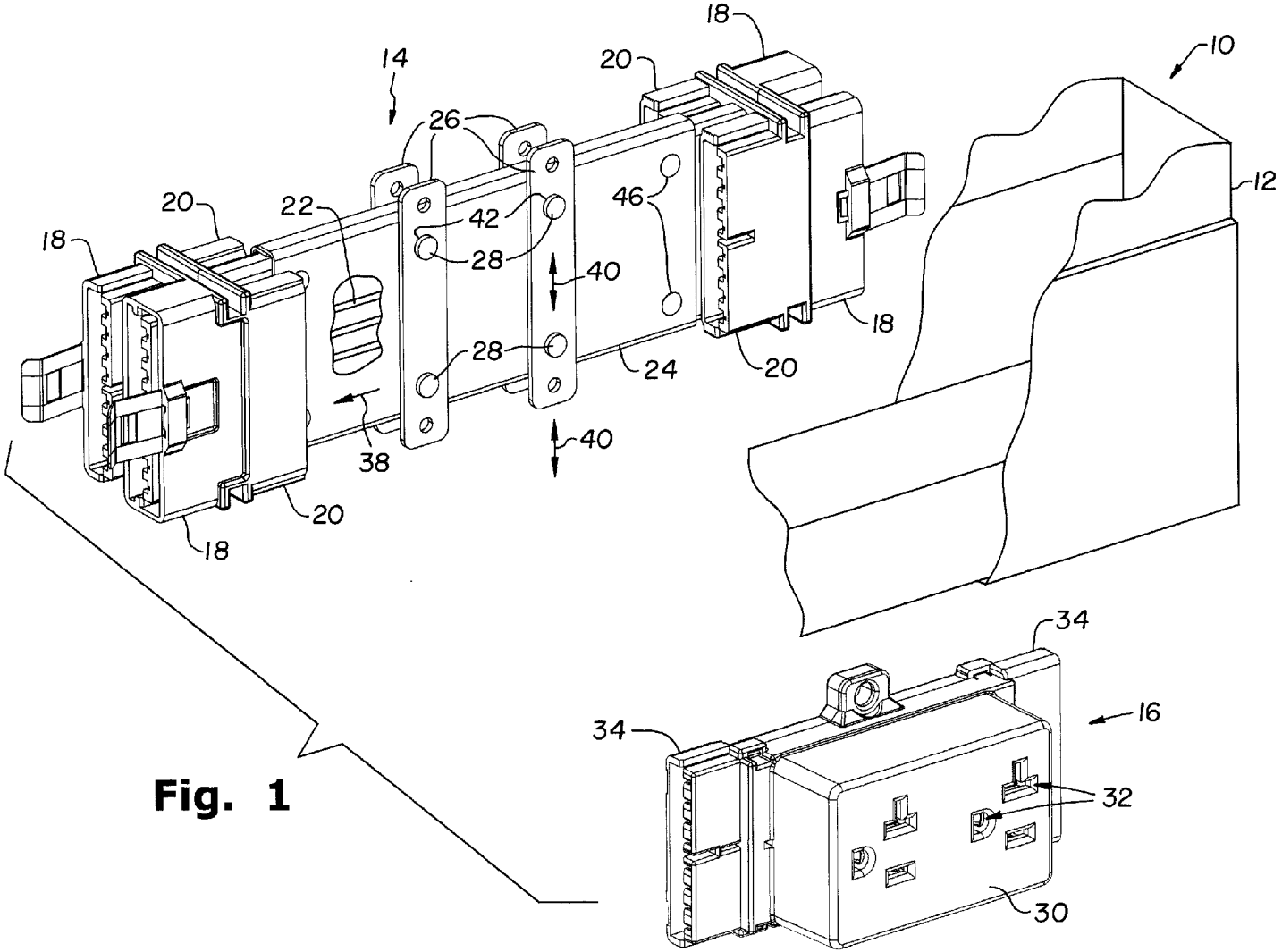
FIG. 1 is perspective view of an embodiment of an electrical distribution harness with a mounting bracket and an electrical receptacle shown in relation to a partial fragmentary view of a modular wall panel according to the present invention.
Figure 2:
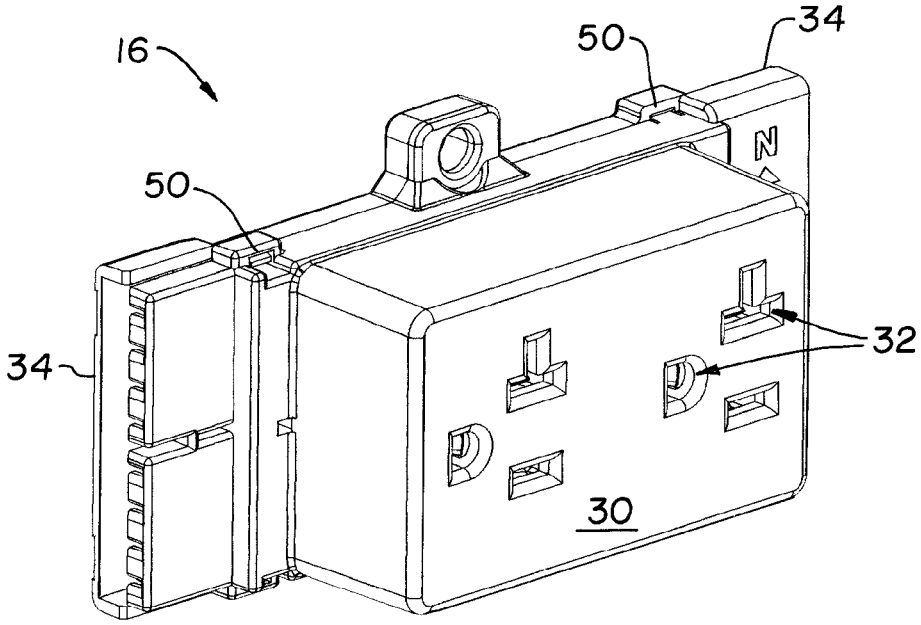
FIG. 2 is a perspective view of the electrical receptacle of FIG. 1.

Referring now to the drawings, and more particularly to FIG. 1, there is shown a modular wall panel assembly 10 which generally includes a modular wall panel 12, an electrical distribution harness 14 and an electrical receptacle 16.

Electrical distribution harness 14 includes electrical connectors 18 and 20 with a plurality of conductors 22 extending therebetween. Conductors 22 are routed in a conduit 24 that serves to define a channel extending from and electrically connected with electrical connectors 18 and 20. The number of conductors 22 can vary from application to application, but will generally include ground, neutral and line conductors, or some combination and/or multiples thereof. Isolated circuit conductors and/or isolated grounds can be included. Conductors 22 electrically interconnect terminals in electrical connectors 20 with corresponding terminals in electrical receptacle 16. Electrical connectors 20 are inwardly facing connectors, and electrical connectors 18 are outwardly facing connectors. Electrical connectors 18 are configured to connect with another connector such as an end connector that is typically connected to a source of electrical power, another electrical distribution harness and/or a jumper cable (all not shown).

Electrical distribution harness 14 also includes structural members 26 that are connected to conduit member 24 by way of fasteners 28, which may be in the form of rivets 28. Structural members 26 are used to position and physically connect electrical distribution harness 14 to wall panel 12. Although fasteners 28 extend through conduit 24 only the protruding head is shown in FIG. 1. For the sake of simplicity, the heads of fasteners 28 will be referred to as heads 28, which protrude above structural members 26 by a height 42.

An electrical receptacle 16 is connected to one of electrical connectors 20. In the embodiment shown, multiple electrical receptacles 16 can be connected to electrical connectors 20 with only one electrical receptacle 16 shown on one side of harness 14. Electrical distribution harness 14 is substantially symmetrical with the side not shown in FIG. 1 being substantially similar to the side that is shown. This allows electrical receptacles to be positioned on each side and at multiple locations on each side of electrical distribution harness 14.

Figure 3:
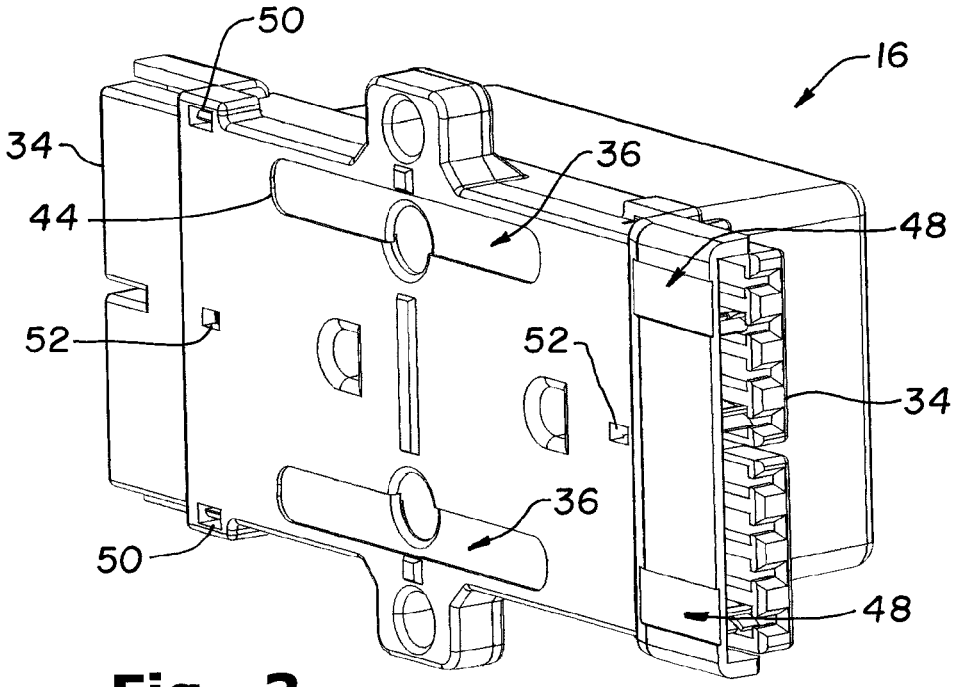
FIG. 3 is another perspective view of the electrical receptacle of FIGS. 1 and 2.
Figure 4:
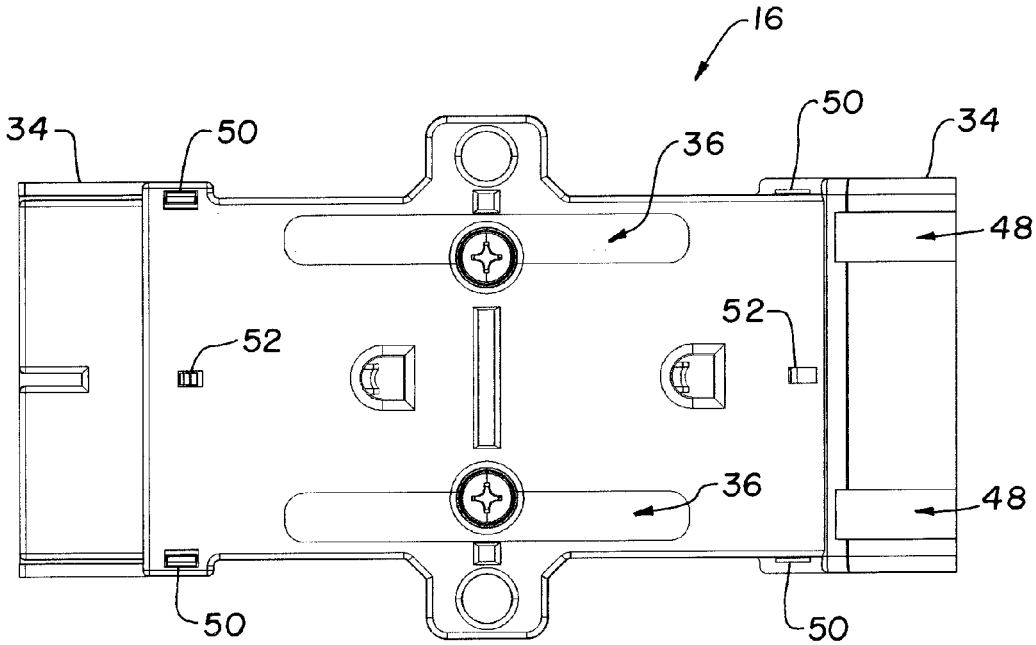
FIG. 4 is a back plane view of the electrical receptacle of FIGS. 1-3.

Electrical receptacle 16 includes a faceplate 30, openings 32 therein, connectors 34, and recesses 36. Openings 32 are positioned to accommodate the insertion of electrical plugs therethrough to interact with electrical connections therein. As can be seen in FIG. 3, there is a ground plug opening on the side opposite faceplate 30 to accommodate the length of the ground plug of an electrical plug. The ground plug typically extends further than the flat blades that convey current flow to an electrical load. The opening on the back of electrical receptacle 16 is one accommodation in the present invention to account for a lower profile electrical assembly in wall panel assembly 10.

Recesses 36 are shaped with a depth 44 to accommodate the positioning of heads 28. Depth 44 is generally equal to or deeper than height 42. Recesses 36 have a longitudinal direction that corresponds to an insertion direction 38 of electrical receptacle 16 with electrical distribution harness 14. This arrangement allows for electrical receptacle 16 to be oriented so that connector 34 aligns with connector 20 and electrical receptacle 16 is slid in direction 38 to engage the connectors. The length of recesses 36 is configured to allow electrical receptacle 16 to be slidingly inserted into any of connectors 20 with heads 28 being in an off center location in recesses 36 when electrical receptacle 16, having been slid relative to harness 14, is fully engaged with a connector 20. Structural members 26 extend in a longitudinal direction 40, which is substantially perpendicular to direction 38.

In a similar fashion recesses 48 are positioned to provide clearance for the passing of the heads of rivets 46 by the housing of electrical receptacle 16, as electrical receptacle 16 is slid into a connector 20. The heads of rivets 46 extend above the surface of conduit 24 and would, without the accommodation of recesses 48, interfere with the insertion of connector 34 into connector 20. The planes of the bottom of recesses 48 may be coplanar with each other, yet are offset from the plane of the bottom of recesses 36. The depth of recesses 48 may be substantially similar to depth 44 of recesses 36. Recesses 48 are located on the hood of connector 34, which is thinner than those typically used in the industry to allow for an overall thinner assembly and to accommodate the clearances of harness assembly 14.

Further, electrical receptacle 16 is assembled using snap latches 50 and 52 to hold the front and back of the assembly together. Latch 50 includes latch arms that are visible on the outside of electrical receptacle 16. In contrast latches 52 latch internally, with the opening shown at 52 being an access, that can allow for the disengagement of latches 52, which along with the disengagement of latches 50, allow for the disassembly of the front and back of the assembly.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical power distribution system, comprising:

an electrical distribution harness including:

a plurality of electrical connectors including a first connector and a second connector;

a plurality of electrical conductors electrically connecting said first connector and said second connector;

a conduit member at least partially enclosing said plurality of electrical conductors between said first connector and said second connector;

at least one fastener element having a head; and at least one structural member connected to said conduit member by way of said fastener element, said head projecting above a surface of said structural member; and an electrical receptacle electrically connectable to at least one of said first connector and said second connector, said electrical receptacle including a housing with at least one recess, said recess being configured to accommodate said head when said electrical receptacle is engaged in one of said first connector and said second connector.

2. The electrical power distribution system of claim 1, wherein said recess has a depth and said head has a height, said depth one of equal to and greater than said height.

3. The electrical power distribution system of claim 1, wherein said recess has a length, said receptacle having a connector with an insertion depth associated with said first connector, said insertion depth being less than said length.

4. The electrical power distribution system of claim 3, wherein said length is oriented in a direction substantially parallel with an insertion direction of said connector of said receptacle with said first connector.

5. The electrical power distribution system of claim 4, wherein said structural member has a longitudinal direction that is oriented substantially perpendicular to said insertion direction.

6. The electrical power distribution system of claim 5, wherein said at least one fastener includes a first fastener and a second fastener both of which connect said structural member to said conduit member, said at least one recess includes a first recess and a second recess, said first recess accommodating said head of said first fastener and said second recess accommodating said head of said second fastener.

7. The electrical power distribution system of claim 6, wherein said at least one structural member includes a first structural member and a second structural member, said first structural member and said second structural member juxtaposed on opposite sides of said conduit member.

8. The electrical power distribution system of claim 7, wherein said first fastener and said second fastener extend through said conduit member to hold both said first structural member and said second structural member to said conduit member.

9. The electrical power distribution system of claim 8, wherein said first fastener and said second fastener include heads on each end projecting respectively above both said first structural member and said second structural member.

10. The electrical power distribution system of claim 9, wherein said recesses on said electrical receptacle are configured to accommodate said heads when said electrical receptacle is positioned on either side of said conduit member.

11. An electrical receptacle for use with an electrical distribution harness including a first connector and a second connector, a plurality of electrical conductors electrically connecting the first connector and the second connector, a conduit member at least partially enclosing the plurality of electrical conductors between the first connector and the second connector, at least one fastener element having a head, and at least one structural member connected to the conduit member by way of the fastener element, the head projecting above a surface of the structural member, the electrical receptacle comprising:

a housing with at least one recess; and a connector extending from said housing, the electrical receptacle electrically connectable to at least one of the first connector and the second connector of the harness, the recess being configured to accommodate the head when the electrical receptacle is engaged in one of the first connector and the second connector.

12. The electrical receptacle of claim 11, wherein said recess has a depth and the head has a height, said depth one of equal to and greater than the height.

13. The electrical receptacle of claim 11, wherein said recess has a length, said connector of the receptacle having an insertion depth associated with said first connector, said insertion depth being less than said length.

14. The electrical receptacle of claim 13, wherein said length is oriented in a direction substantially parallel with an insertion direction of said connector of said receptacle with the first connector.

15. The electrical receptacle of claim 14, wherein the structural member has a longitudinal direction that is oriented substantially perpendicular to said insertion direction.

16. The electrical receptacle of claim 15, wherein the at least one fastener includes a first fastener and a second fastener both of which connect the structural member to the conduit member, said at least one recess includes a first recess and a second recess, said first recess accommodating the head of the first fastener and said second recess accommodating the head of the second fastener.

17. The electrical receptacle of claim 16, wherein the at least one structural member includes a first structural member and a second structural member, the first structural member and the second structural member juxtaposed on opposite sides of the conduit member.

18. The electrical receptacle of claim 17, wherein the first fastener and the second fastener extend through the conduit member to hold both the first structural member and the second structural member to the conduit member.

19. The electrical receptacle of claim 18, wherein the first fastener and the second fastener include heads on each end projecting respectively above both the first structural member and the second structural member.

20. The electrical receptacle of claim 19, wherein said recesses on said electrical receptacle are configured to accommodate the heads when the electrical receptacle is positioned on either side of the conduit member.

* * * * *